US005644803A

United States Patent [19]

Wilson

[11] Patent Number: 5,644,803

[45] Date of Patent: Jul. 8, 1997

[54] SPA COVER SUPPORT ASSEMBLY

[76] Inventor: Richard M. Wilson, 14777 Hillside Dr., Caldwell, Id. 83605

[21] Appl. No.: 605,490

[22] Filed: Feb. 26, 1996

[51] Int. Cl.[6] ..... E04H 4/06

[52] U.S. Cl. ..... 4/500; 220/331

[58] Field of Search ..... 4/494, 498, 500; 220/263, 329, 331

[56] References Cited

U.S. PATENT DOCUMENTS

| | | | |
|---|---|---|---|
| 2,788,849 | 4/1957 | Lingard | 160/188 |
| 2,940,410 | 6/1960 | Meek | 114/202 |
| 3,341,180 | 9/1967 | Dashio | 256/1 |
| 3,832,741 | 9/1974 | Ward | 4/500 |
| 4,753,054 | 6/1988 | Butler | 52/18 |
| 4,831,792 | 5/1989 | Berger | 52/66 |
| 4,853,985 | 8/1989 | Perry | 4/498 |
| 4,991,238 | 2/1991 | Forrest | 4/498 |
| 5,257,485 | 11/1993 | Kawaguchi et al. | 52/66 |
| 5,426,899 | 6/1995 | Jones | 52/63 |
| 5,471,685 | 12/1995 | Cross | 4/500 |

FOREIGN PATENT DOCUMENTS

| | | | |
|---|---|---|---|
| 3416889 | 11/1985 | Germany | 4/498 |

*Primary Examiner*—Charles E. Phillips
*Attorney, Agent, or Firm*—Frank J. Dykas

[57] ABSTRACT

A spa cover support assembly is provided with a plurality of support arms having upper and lower ends with the lower ends pivotally attached to an external surface of the spa side wall for pivotal rotation of the upper ends of the support arms through an arc from a point above and adjacent to the side wall to a point away from the side wall at a point where the upper ends of the support arms are within the generally horizontal plane defined by the top surfaces of the side walls and at a distance away from the side wall wherein the center of gravity of the spa cover supported between the side wall and the upper ends of the support arms will fall between the side wall and the upper ends of the support arm assembly. A generally horizontal support bar is provided attached to the upper ends of the support arms for supporting the spa cover.

7 Claims, 3 Drawing Sheets

SPA COVER SUPPORT ASSEMBLY

DESCRIPTION

BACKGROUND OF THE INVENTION

1. Technical Field

This invention generally relates to spas, and more specifically to support assemblies for spa covers.

2. Background

Spas, or hot tubs as they are commonly known, are devices in which water is kept at an elevated temperature and benches or seats are provided for the users of the spa to sit in the warm water. They are usually stored outside. A cover is often used on spas to help retain the heat of the water. Spa covers can be a flexible sheet of plastic with air bubbles in it. They can also be large, rigid structures with foam insulation. The large, rigid, foam design of spa covers is often hinged in the middle with a fabric hinge, which allows the spa cover to be folded in half upon itself. The spa cover must be removed from the spa before the spa can be used. This is accomplished by moving the spa cover on to an adjacent deck, leaning one edge of the spa cover on the ground with the other edge of the spa cover leaning against the spa, or by using a storage device. One type of prior art spa storage device is a U-shaped arm which is hingedly attached at ode end to the side of the spa, and attached to the joint of the spa cover at its other end. Using this type of spa cover removal device, the spa cover is first folded in half upon itself, and then slid to a vertical position along side the spa. The spa cover holding device supports the two halves of the spa cover at their hinge line in a vertical position.

The above-mentioned means of removing and storing a spa cover presents certain difficulties. Not every spa has an adjacent deck on which to slide it, and those that do have such a deck are often of wood, which can tear or scratch the spa cover itself. Many spa covers are large, bulky, and heavy, and lowering them to a vertical position next to the spa and leaning one edge against the spa is difficult for one person to do. When the type of device which supports the spa cover in a vertical position along side the spa wall, the user still has to lift the spa cover from a vertical position to a horizontal position on top of the spa. This can be difficult for one person to do. Accordingly, it is an object of this invention to provide a means for comfortably removing a bulky spa cover from the spa and storing it along side the spa.

Another object of the invention is to provide a means for easily reinstalling the spa cover from the storage device to the spa itself.

DISCLOSURE OF INVENTION

These objects are achieved in a spa cover support assembly which incorporates the basic concept that there is a support arm, and in the preferred embodiment two support arms, which are pivotally attached at their bottom ends to an external surface of a spa side wall for pivotal rotation of the upper end of the control arms through an arc from a point above and adjacent to the side wall to a point away from the side wall and at a point where the upper end of the support arms lie within a generally horizontal plane defined by the top surface of the spa.

A horizontal support member is provided, which in the preferred embodiment, is a horizontal bar which interconnects the top ends of each of the support arms and is used to support, in cantilevered fashion, a spa cover in a position where it rests atop the horizontal support bar and the top surface of the spa side wall, such that the spa cover's center of gravity falls between the horizontal support arm and the top surface of the spa end wall.

A pivot biasing assembly is provided and includes a pair of weight tubes that are attached to the side wall of the spa. Inside each weight tube is suspended a weight which is connected by flexible linkage and a pulley or slip ring to the control arms, so as to pull the control arms to the vertical position when unloaded and not being used to support a spa cover. A horizontal roller tube overfits the horizontal support bar and serves as a rotational bearing surface for the bottom of the spa cover as it is being slid to and from its storage position, so as to equalize rotation of the support arms and to minimize wear.

In use, the spa cover assembly, when not being used to support the spa cover, is in its resting, vertical position, adjacent to the side wall of the spa. The upper ends of the support arms and the horizontal support bar, in this resting position, lie in the position above the plane generally defined by the top surfaces of the side walls of the spa. The spa cover assembly remains in its vertical resting position as a result of the weights pulling on the lines holding the control arms. To use the spa cover assembly to support the spa cover in a storage position, the spa cover is slid off of the top surface of the spa in the direction of the spa cover assembly and its support arms. In response to contact with the spa cover, the support arms extend outwardly away from the side of the spa with the horizontal support bar swinging in an arc away from the spa from a position above the side wall to a position generally in a plane defined by the top surfaces of the spa. When the horizontal support bar is generally level with the top surfaces of the spa, the spa cover rests atop the roller tube from where further extension of the spa cover causes the roller to turn as the spa cover continues to extend.

At some point in its removal, the spa cover is typically folded in half and is then supported between the spa cover assembly and the edge of the spa, such that the center of gravity of the folded spa cover lies between the two contact points.

BEST MODE FOR CARRYING OUT INVENTION

Figure 2:
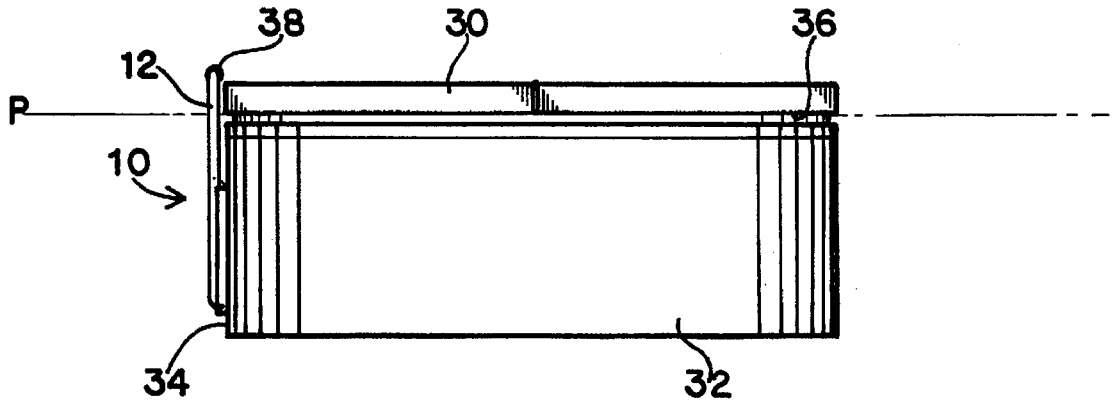
FIG. 2 is a side view of a spa with a spa cover support assembly attached, in the resting position.
Figure 3:
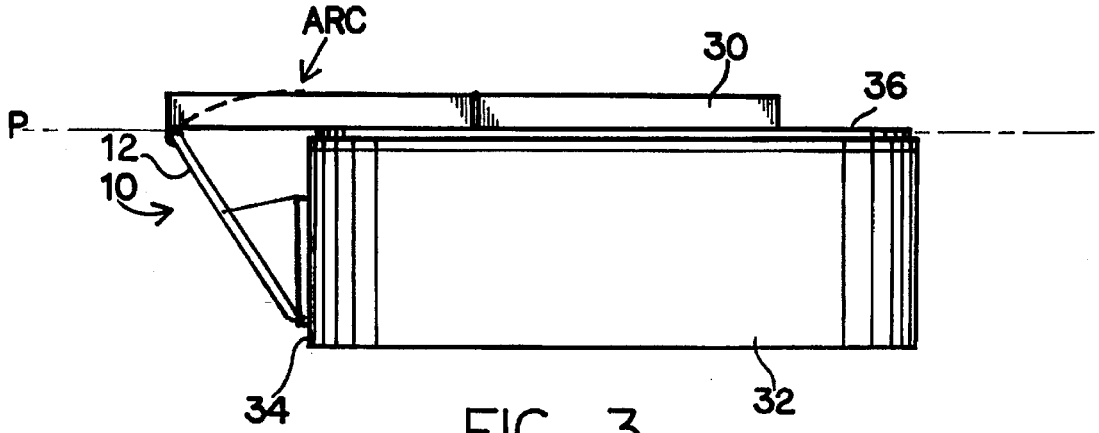
FIG. 3 is a side view of a spa with a spa cover support assembly attached with the spa cover pushed to one side of the spa, but not yet removed.
Figure 4:
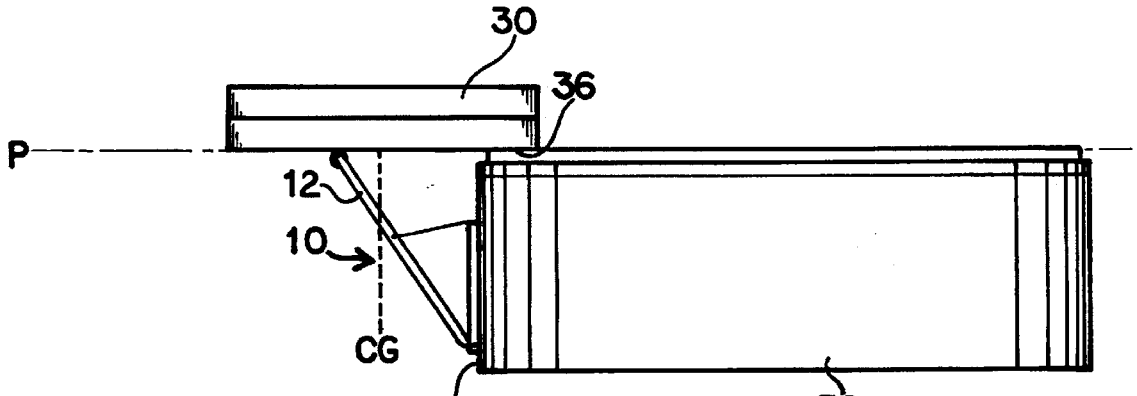
FIG. 4 is a side view of a spa with a spa cover support assembly attached showing the spa cover in its storage position.

Referring to FIGS. 1 through 5, an assembly for supporting a spa cover in a storage position is generally designated as 10, and is illustrated in its preferred embodiment. The preferred assembly for supporting a spa cover in a storage position is illustrated in FIG. 4.

Figure 1:
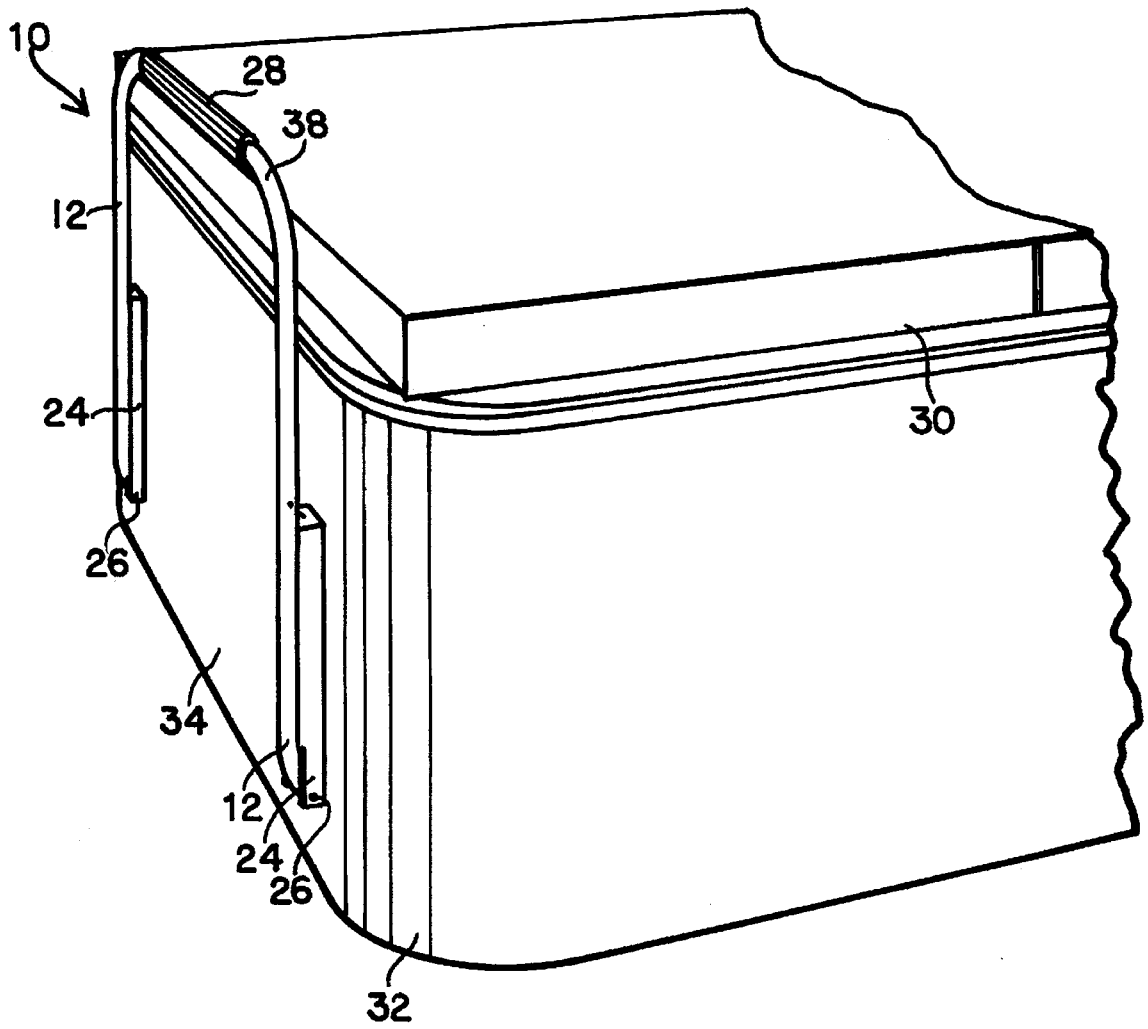
FIG. 1 is a perspective view of the spa cover support assembly attached to the side of a spa.
Figure 5:
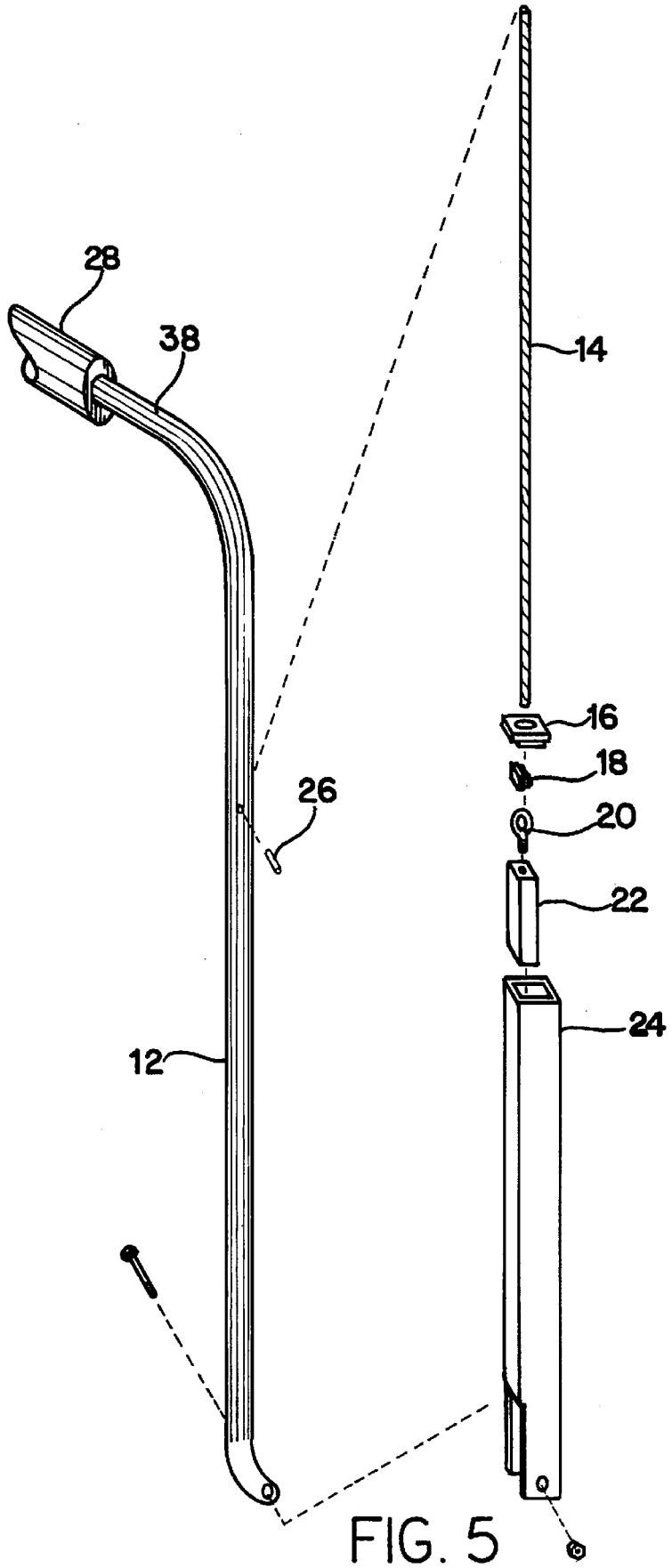
FIG. 5 is an exploded view of the parts which make up the spa cover support assembly.

The basic concept is that there is a support arm 12, as shown in FIG. 5, and in the preferred embodiment two support arms 12, as shown in FIG. 1, which is pivotally attached at its bottom end to an external surface of a spa side wall, for pivotal rotation of the upper end through an arc, as shown in FIG. 3 from a point above and adjacent to the side wall to a point away from the side wall at a point where the upper end of support arm 12 lies within a generally horizontal plane P defined by the top surfaces 36 of spa 32.

Some sort of horizontal support member is provided, which in the preferred embodiment is horizontal bar 38 which interconnects the top ends of each of the two support arms 12, and is used to support, in cantilevered fashion, spa cover 30 in a position where it rests atop the horizontal support bar 38 and the top surface of the spa side wall 34, such that the spa cover's center of gravity, Cg, as shown in FIG. 4, falls between horizontal support arm 38 and top surface 36 of end wall 34. As stated, in the preferred embodiment, a pair of support arms 12 are used. However, it should be apparent to those skilled in the art that there are a variety of other configurations, including a single support arm 12 connected to horizontal support bar 38, or, in a pair of matched support arms 12, without the interconnection feature of support bar 38, or finally, more than two support arms either connected by horizontal support bar or not connected.

As shown in FIG. 5, a pivot biasing assembly including a pair of weight tubes 24 that are attached to the side wall 34 of the spa 32. Inside each weight tube 24 is suspended a weight 22. The weights 22 are connected to flexible linkage material 14 by eyebolts 20 which pass over pulleys 18 and through tube caps 16. Flexible connectors 14 attach to eyebolts 20 at one end, and to connection pins 26 of arms 12 at the other end. Support arms 12 hingedly attach at one end to a weight tube 24.

It should also be apparent to those skilled in the art that there are a number of other pivot biasing designs which may work almost as well as the design shown in the preferred embodiment. These include spring-loaded pivoting hinges for connecting control arms 12 to the side of a spa side wall, or gas struts or even simple coil springs or bungie cords interconnecting control arms 12 to some point on the spa side wall above the pivot point.

However, these alternate pivot biasing systems have disadvantages which are not intuitively apparent. First, tube caps 16 provide an automatic travel stop, such that a child swinging on the support bar 38 cannot swing the assembly any farther out once the weights 22 engage tube caps 16. Secondly, spring loaded hinges or bracing means will, if pulled back and then suddenly released, will snap the support arms 12 against the side of the spa. Weights 22 are "gravity powered" and will return the support arms at a slower speed.

Regardless of the pivot biasing system employed, and in addition to its functional purpose in the spa cover support assembly, there is a safety advantage to employing a pivot biasing system. Without it, to have support arms angled out at a fixed location results in permanent fixed protrusions, including a horizontal support bar, which is located at approximately face or eye level for small children. By employing a pivot biasing system, the support bar is drawn up and away from the location where small children could encounter it, either in running, playing, or using it as a trapeze from which to swing.

In this preferred embodiment, support arms 12 are interconnected at their top ends to horizontal support bar 38. Roller tube 28 is provided, in the preferred embodiment, as a rotational bearing surface for horizontal support bar 38. This is done for a number of reasons. First, roller tube 28 equalizes out the forces being transmitted to support arms 12 to the extent that both will rotate out a comparably equal rates and thus the system has a reduced tendency toward binding. It is also done to provide a rolling bearing surface for the bottom of spa cover 30 to minimize wear. However, it should be obvious to those skilled in the art that although roller tube 28 is included in the preferred embodiment, it is not necessary to the functioning of spa cover assembly 10 if the operator exercises care, or binding is to be tolerated.

FIGS. 1 and 2 show spa cover assembly 10 in its resting, generally vertical, position adjacent to side wall 34 of spa 32. As can be seen, the upper ends of support arms 12 and horizontal support bar 38 lie in a position above plane P as generally defined by the top surfaces of side walls of spa 32. Spa cover assembly 10 remains in its vertical resting position as a result of weights 22, through flexible connectors 14, pulling support arms 12 and holding them in a vertical position. To use the spa cover assembly 10 to support the spa cover 30 in a storage position, spa cover 30 is first slid off the top surfaces of spa 32 in the direction of spa cover assembly 10 and support arms 12. In response to contact with spa cover 30, support arms 12 extend outward away from side 34 of spa 32 with horizontal support bar 38 attached to the top ends of support arms 12 swinging in the arc, as shown in FIG. 3, from a position above the side wall 34 to a position generally in the plane defined by the top surfaces of spa 32.

When horizontal support bar 38 is generally level with the top surfaces of spa 32, the spa cover 30 rests on top of roller tube 28 and horizontal support bar 38, further extension of spa cover 30 causes roller tube 28 to turn as the spa cover continues to extend.

At some point in its removal, spa cover 30 is typically folded in half, as is shown in FIG. 4. FIG. 4 shows the folded spa cover 30 supported by spa cover assembly 10 and edge 36 of spa 32, such that center of gravity Cg of the folded spa cover lies between the two contact points.

Reinstalling spa cover 30 atop spa 32 involves the reverse steps as for removing it. As spa cover 30 is pulled back toward spa 32, the biasing assembly formed of weight tubes 24 and weights 22 causes support arms 12 to be urged back to the vertical resting position. At some point in time, the center of gravity Cg for the folded spa cover will pass over the top surface 36 of side wall 34, at which time spa cover 30 can be unfolded and pulled into its final position over spa 32.

In practice, the use of spa cover assembly 10 enables a spa user to uncover spa 32 without ever lifting cover 30 off of the top surfaces 36, but rather only being required to slide it. This facilitates the use of spa cover bracket 10 by a single person, as opposed to the normal two required to lift and remove the spa cover 30.

While there is shown and described the present preferred embodiment of the invention, it is to be distinctly understood that this invention is not limited thereto but may be variously embodied to practice within the scope of the following claims.

Accordingly, what I claim is:

1. A spa cover support assembly for use with a spa having side walls with top surfaces defining a generally horizontal plane for slidably supporting a removable spa cover, said spa cover support assembly comprising:

a support arm having an upper end and a bottom end, pivotally attached at its bottom end to a spa side wall for pivotal rotation of the said upper end through an arc from a point above and adjacent to said side wall to a point away from said side wall at a point where said upper end of said support arm is within the generally horizontal plane defined by the top surfaces of the side walls, and at a distance away from the side wall wherein the center of gravity of a spa cover supported between the side wall to which the lower end is pivotally attached and the upper end of the support arm will fall between the side wall and the upper end of said support arm;

means for supporting a spa cover attached to the upper end of said support arm; and pivot bias means for holding the support arm in a generally vertically position when not supporting said spa cover, and for permitting arcuate rotation of the upper end of said support arm when said spa cover is slid from the top surfaces of the side walls said means for supporting.

2. The spa cover support assembly of claim 1 wherein the means for supporting a spa cover attached to the upper end of said support arm further comprises:

a generally horizontal roller bar rotatably attached to said upper end of the support arm for supporting an end of said spa cover.

3. A spa cover support assembly for use with a spa having side walls with top surfaces defining a generally horizontal plane for slidably supporting a removable spa cover, said spa cover support assembly comprising:

a plurality of support arms, each having an upper end and a bottom end, in parallel juxtaposed relationship, each pivotally attached at its bottom end to the same spa side wall for pivotal rotation of the said upper ends of said support arms through parallel arcs from a point above and adjacent to said side wall to a point away from said side wall at a point where said upper ends are within the generally horizontal plane defined by the top surfaces of the side walls, and at a distance away from the side wall wherein the center of gravity of a spa cover supported between the side wall to which the lower ends of said support arms are pivotally attached and the upper ends of the support arms will fall between the side wall and the upper ends of said support arms;

means for supporting a spa cover attached to the upper ends of said support arms; and pivot bias means for holding the support arms in a generally vertically position when not supporting said hot tub cover, and for permitting arcuate rotation of the upper ends of said support arms when said spa cover is slid from the top surfaces of the side walls unto the horizontal support bar.

4. The spa cover support assembly of claim 3 wherein the means for supporting a spa cover attached to the upper end of said support arms further comprises:

a generally horizontal support bar attached to said upper ends of, and spanning between the support arms for supporting an end of said spa cover.

5. The spa cover support assembly of claim 4 wherein horizontal support bar further includes a rotatable bearing surface rotatably attached to said horizontal support bar for supporting a spa cover.

6. The spa cover support assembly of claim 4 wherein said pivot bias means further comprises:

a plurality of vertically oriented weight receiving tubes, each attached to the side wall of the spa adjacent to each of the plurality of support arms for vertically and slidably receiving and holding a weight;

a plurality of weights each disposed within a weight tube for slidable vertical motion; and a plurality of flexible connectors, each connecting a weight to a support arm above its pivotal attachment point, for biasing said support arm to a vertical position adjacent to said side wall.

7. The spa cover support assembly of claim 3 wherein said pivot bias means further comprises:

a plurality of vertically oriented weight receiving tubes, each attached to the side wall of the spa adjacent to each of the plurality of support arms for vertically and slidably receiving and holding a weight;

a plurality of weights each disposed within a weight tube for slidable vertical motion; and a plurality of flexible connectors, each connecting a weight to a support arm above its pivotal attachment point, for biasing said support arm to a vertical position adjacent to said side wall.

* * * * *